US008186109B2

(12) United States Patent
Warminsky

(10) Patent No.: US 8,186,109 B2
(45) Date of Patent: May 29, 2012

(54) RE-CONFIGURABLE ARMORED TACTICAL PERSONNEL AND COLLECTIVE TRAINING FACILITY

(75) Inventor: Michael F. Warminsky, Ringoes, NJ (US)

(73) Assignee: UXB International, Inc., Blacksburg, VA (US)

( * ) Notice: Subject to any disclaimer, the term of this patent is extended or adjusted under 35 U.S.C. 154(b) by 199 days.

(21) Appl. No.: 12/405,651

(22) Filed: Mar. 17, 2009

(65) Prior Publication Data

US 2009/0282749 A1 Nov. 19, 2009

Related U.S. Application Data

(63) Continuation-in-part of application No. 11/283,630, filed on Nov. 21, 2005, now abandoned.

(51) Int. Cl.
*E04H 1/02* (2006.01)
*E04H 1/12* (2006.01)

(52) U.S. Cl. ..... 52/79.1; 52/79.2; 52/79.5; 52/79.9; 52/745.03; 52/745.02

(58) Field of Classification Search ..... 52/79.1, 52/79.2, 79.5, 79.9, 79.12, 64, 72, 745.03, 52/745.02; 89/36.04
See application file for complete search history.

(56) References Cited

U.S. PATENT DOCUMENTS

| | | | | |
|---|---|---|---|---|
| 1,995,573 | A | 3/1935 | Matthews | |
| 3,115,819 | A | 12/1963 | Mahlmeister et al. | |
| 3,146,497 | A | 9/1964 | Short et al. | |
| 3,175,262 | A * | 3/1965 | Wilson | 24/16 R |
| 3,752,511 | A * | 8/1973 | Racy | 24/287 |
| 3,792,558 | A * | 2/1974 | Berce et al. | 52/79.7 |
| 3,793,796 | A | 2/1974 | Hughes | |
| 3,800,493 | A | 4/1974 | Livingston | |
| 3,832,811 | A | 9/1974 | Briel, Jr. | |
| 4,164,901 | A | 8/1979 | Everett | |
| 4,195,453 | A | 4/1980 | Komendant | |
| 4,282,690 | A | 8/1981 | Meheen | |
| 4,592,175 | A | 6/1986 | Werner | |
| 4,599,829 | A * | 7/1986 | DiMartino, Sr. | 52/79.7 |
| 4,644,708 | A | 2/1987 | Baudot et al. | |
| 5,285,604 | A | 2/1994 | Carlin | |
| 5,353,557 | A * | 10/1994 | Lerner et al. | 52/106 |
| 5,402,608 | A | 4/1995 | Chu | |
| 5,724,774 | A | 3/1998 | Rooney | |
| 5,822,936 | A | 10/1998 | Bateman | |
| 6,166,744 | A | 12/2000 | Jaszlics et al. | |
| 6,254,394 | B1 | 7/2001 | Draper et al. | |

(Continued)

OTHER PUBLICATIONS

Canadian Office Action for Application No. 2,630,593 dated Nov. 4, 2009.

*Primary Examiner* — Phi Dieu Tran A
(74) *Attorney, Agent, or Firm* — Patterson & Sheridan, L.L.P.

(57) ABSTRACT

The present invention is generally directed to a reconfigurable armored unit for use in training exercises. In one aspect, a reconfigurable training facility is provided. The reconfigurable training facility includes a first modular unit. The reconfigurable training facility further includes a second modular unit, wherein each modular unit includes a frame with corner connection members and a grid system, whereby the corner connection members are used to connect the modular units together and whereby the grid system is used to selectively support a plurality of panels. In another aspect, a modular unit for use in a reconfigurable training facility is provided. In yet another aspect, a method of forming a reconfigurable training facility is provided.

25 Claims, 5 Drawing Sheets

U.S. PATENT DOCUMENTS

| | | | | |
|---|---|---|---|---|
| 6,655,095 | B1 | 12/2003 | Pingel | |
| 6,925,761 | B1 * | 8/2005 | De La Marche | 52/79.7 |
| 6,959,515 | B1 | 11/2005 | Beighton | |
| 7,073,426 | B1 | 7/2006 | White | |
| 7,178,297 | B2 | 2/2007 | Seavy | |
| 7,185,467 | B2 | 3/2007 | Marty | |
| 7,246,471 | B2 | 7/2007 | Riemann et al. | |
| 7,827,738 | B2 * | 11/2010 | Abrams et al. | 52/79.1 |
| 2002/0036617 | A1 | 3/2002 | Pryor | |
| 2003/0003424 | A1 | 1/2003 | Shechter et al. | |
| 2003/0091970 | A1 | 5/2003 | Fast et al. | |
| 2003/0152892 | A1 | 8/2003 | Huang et al. | |
| 2005/0022658 | A1 | 2/2005 | Bateman et al. | |

* cited by examiner

RE-CONFIGURABLE ARMORED TACTICAL PERSONNEL AND COLLECTIVE TRAINING FACILITY

CROSS-REFERENCE TO RELATED APPLICATIONS

This application is a continuation-in-part of U.S. patent application Ser. No. 11/283,630, filed on Nov. 21, 2005, now abandoned which is herein incorporated by reference.

BACKGROUND OF THE INVENTION

1. Field of the Invention

Embodiments of the present invention generally relate to a training facility for military and law enforcement personnel. More particularly, embodiments of the present invention pertain to a reconfigurable armored unit for use in training exercises.

2. Description of the Related Art

To maintain proficiency in the use of firearms, typically military and law enforcement personnel engage in target practice. Traditionally, target practice has been conducted on a range in which targets were placed a distance away from the shooter. However, target practice on a range does not adequately train military and law enforcement personnel for many real life situations. Therefore, structures that include ballistic walls in arrangements to resemble a house or other building were formed. These structures, typically referred to as shoot houses, enable military and law enforcement personnel to train in situations in which the officer faces realistic threats to their safety.

Traditional shoot houses were originally constructed out of concrete, gravel filled walls, or tire walls. While these shoot houses provided a marked improvement over traditional training at a target range, they still do not feel as realistic as conventional looking walls.

As technology improved, the traditional shoot house became more sophisticated. Today, as part of most military and law enforcement training scenarios, dynamic encounters, while either moving or against moving "Friend-Foe" targets in realistic settings, are required. Currently, military and law enforcement personnel use a variety of facilities including automated and non-automated static ranges, convoy training structures, and shoot houses to fulfill their training requirements.

Combat veterans and progressive training instructors have acknowledged that the human body and mind have predictable, instinctive responses to surprise and lethal threats. While the basics of weapons handling and marksmanship are important skills for all shooters, they are not the basis for success during most lethal encounters involving the defensive use of a firearm. Trainees are much more likely to be caught off-guard by an aggressive attacker in close quarters and low light conditions than when "confronted" by a simulated lethal threat in broad daylight standing 25 yards in front of an earthen berm.

An environment that accurately recreates situational realism is requisite to firearms/tactical training programs, especially with the shift in doctrine to urban training to support the global war on terror and to allow our war fighters to train as they fight. As such, static (non-automated) outdoor ranges with permanent target positions are least desirable to meet the changing mission requirements for these training exercises. With regard to tactical training, the traditional shoot house is also not fully adequate or desirable because of life cycle costs and lack of an opposing force in live training scenarios. Further, the traditional shoot house requires significant design time and construction efforts to erect. Furthermore, the traditional shoot house lacks flexibility in modifying training scenarios once erected. Additionally, the traditional shoot house lacks realism for today's training mission requirements. Also, the traditional shoot house includes a large surface danger zone (SDZ) footprint. In addition, the traditional shoot house typically raises encroachment, nuisance, and/or noise issues. Furthermore, traditional shoot houses typically have an open top due to air quality issues among other things. Therefore, there is a need for an improved shoot house arrangement

SUMMARY OF THE INVENTION

The present invention is generally directed to a reconfigurable armored unit for use in training exercises. In one aspect, a reconfigurable training facility is provided. The reconfigurable training facility includes a first modular unit. The reconfigurable training facility further includes a second modular unit, wherein each modular unit includes a frame with corner connection members and a grid system, whereby the corner connection members are used to connect the modular units together and whereby the grid system is used to selectively support a plurality of panels.

In another aspect, a modular unit for use in a reconfigurable training facility is provided. The modular unit includes a portable structural member having corner connection members that are configured to be interconnectable with another portable structural member. The modular unit further includes a plurality of composite panels mounted on a grid system in the portable structural member, wherein the panels are reconfigurable on the grid system between a first training scenario configuration and a second training scenario configuration.

In yet another aspect, a method of forming a reconfigurable training facility is provided. The method includes positioning a first modular unit at a predetermined location, the first modular unit having corner connection members. The method further includes positioning a second modular unit adjacent the first modular unit, the second modular unit having corner connection members. Furthermore, the method includes connecting at least two corner connection members in the first modular unit with at least two corner connection members in the second modular unit to form a first training scenario configuration. The method also includes disconnecting the corner connection members in the modular units. Additionally, the method includes repositioning the second modular unit relative to the first modular unit and connecting at least two corner connection members in each modular unit to form a second training scenario configuration.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
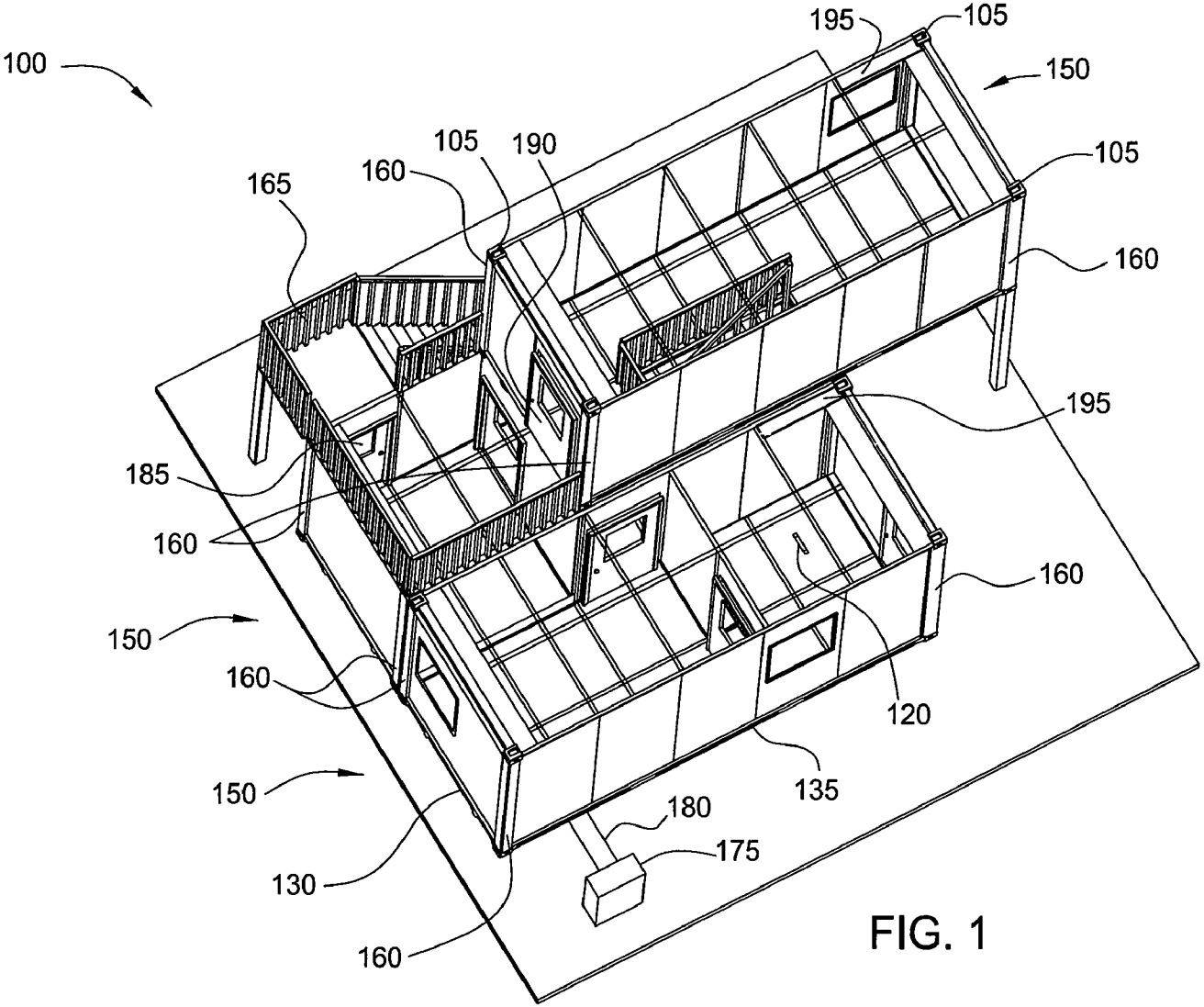
FIG. 1 is a view illustrating one embodiment of a reconfigurable armored tactical personnel and collective training facility (RATPAC) for live training exercises.

The present invention is generally directed to a modular unit for use in force-on-force training exercises in order to train fighters as they fight. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same reference numerals. The drawings may be, but are not necessarily, to scale and the proportions of certain parts have been exaggerated to better illustrate details and features described below. One of normal skill in the art of shoot houses will appreciate that the various embodiments of the invention can and may be used in all types of shoot houses.

FIG. 1 is a view illustrating one embodiment of a reconfigurable armored tactical personnel and collective training facility (RATPAC) 100 for live training exercises. As shown in FIG. 1, the RATPAC 100 includes three modular units 150 configured in a cluster. It is to be understood, however, that the RATPAC 100 may include any number of modular units without departing from principles of the present invention. For ease of explanation, the invention will be described generally as it relates to a single building structure. It is to be understood, however, that the invention may be employed in any number of building structures without departing from principles of the present invention.

The modular units 150 in the RATPAC 100 are configured to construct the tactical training facility. Each modular unit 150 is portable, thereby allowing the RATPAC 100 to be reconfigured with minimal effort. For illustrative purposes, the roof on each modular unit 150 has been removed. The modular unit 150 is made from a frame and panel construction. As shown, the interior of each modular unit 150 may be configured with various features, such as windows, doors, stairwells, walls, and hallways but the overall structure of each modular unit 150 is constructed to a predetermined standard design or structural foot pattern. For instance, each modular unit 150 includes a standard width and a standard length. Additionally, the modular unit 150 includes a vertical support structure 160 at each corner that is interconnected with horizontal support structures 130, 135. As illustrated, each support structure 160 includes a corner connection member 105 at an upper end and a lower end. In one embodiment, the corner connection member 105 is a corner casting in order to facilitate the use of ISO-3874 connectors. The standard design allows each modular unit 150 to be arranged in a side by side configuration or in a stacked configuration by connecting the corner connection members 105 without substantially modifying the modular unit 150. Additionally, the standard design allows the modular unit 150 to be prefabricated prior to assembly of the RATPAC 100, thereby reducing the design and construction efforts. Another benefit of a standard design is that the modular unit 150 may be disassembled and reconfigured with minimal effort, thereby adding flexibility in modifying training scenarios once erected. In one embodiment, the modular unit is containerized. For instance, the modular unit is built on ISO 1486-1 container concepts, with foldable frames for flat-pack shipping. In addition, other features, such as an exterior stairway 165 may be added to the RATPAC 100 to create the realistic tactical training facility. Exterior landing for stairway may be hinged to frame 125 to facilitate set-up and reconfiguration.

Generally, each modular unit 150 includes interior and exterior panels that consist of standard dimension panels mounted on a grid system. The interior and exterior panels may include solid panels (single and double sided), window panels, door panels, with or without breach capabilities. The interior of each modular unit 150 includes bullet containment walls configured to allow live training within the modular unit 150. More specifically, the walls in each modular unit 150 include armored panels and/or armored ballistic panels to maintain the integrity of the walls when rounds are shot in the modular unit 150. The exterior facades of each modular unit 150 can also be mounted on the grid system to provide additional realism when the RATPAC 100 training facility is used as part of a Military Operations on Urban Terrain (MOUT) or Combined Arms Collective Training Facility (CACTF) to simulate the desired objective. Additionally, the exterior of each modular unit 150 may include brick and mortar to create a realistic tactical training facility. In another embodiment, the modular unit 150 may be configured for simulated munitions, such as paintballs. In this embodiment, the lightweight walls may be used in place of the bullet containment walls, The modular unit 150 may also be configured for simulated munitions, such as biodegradable marking projectiles, such as dye marking rounds. The use of biodegradable marking projectiles allow the environmental impacts to be minimized, while offering realistic training. A traditional drawback to dye marking rounds is that the dye marking rounds cannot penetrate the walls like small arms rounds. To overcome this deficiency, the modular unit 150 may include a shoot-through panel (or wall). The shoot-through panel looks similar to the other panels but is constructed with skins that allow through wall penetration of dye marking rounds.

Each modular unit 150 typically includes several subsystems for providing a controlled environment within the modular unit 150. For example, each modular unit 150 may have a subsystem 195, such as closed circuit television (CCT) either wall or ceiling mounted, or embedded within a composite wall panel to afford eye-level recording of human factor elements, computer controlled targetry arrangement, sound effects, power, smoke, smell and an airflow ceiling ventilation system. Typically, each subsystem is integral to the modular unit 150 and is connected via an umbilical cord 180 to a central control module in a control room 175. In another embodiment, each modular unit 150 is connected to the control room 175 through a wireless network. The subsystems may also be connected to an after action review (AAR)/classroom space, as well as mechanical/electrical units that are configured to meet each application's requirements. The subsystem arrangement allows the modular unit 150 to be mobile and affords the end-user a plug and play product.

The RATPAC 100 may include the capability of integral breaching walls 185 and doors 190 to gain entry to the modular unit 150 and/or individual rooms to add realism to the training session. The interior and exterior "breach panels" simulating walls 185 and doors 190 are substituted for the standard armor panels, at predetermined entry points, allowing for demolition effects simulator (DES) or mechanical breaching techniques without damaging the modular unit 150. In addition, each modular unit 150 offers the added realism of traditional height ceilings and an active ventilation system, thereby reducing the (SDZ) footprint and encroachment or noise issues. Further, each modular unit 150 includes room sizes that can be configured to match the required tactical scenario, as well as flexibility afforded by portable target systems 120 that are easily relocated/reprogrammed to change training scenarios. In one embodiment, the target systems 120 include an image that changes between a friend scenario and a foe scenario. In this embodiment, the target system 120 may include a board member that rotates about an axis point, wherein one face of the board includes a friend image and another face of the board includes a foe image. In another embodiment, the target system 120 may include a commercial-off-the-shelf (COTS) targetry system, such as computerized image targetry or instrumentation.

Figure 3:
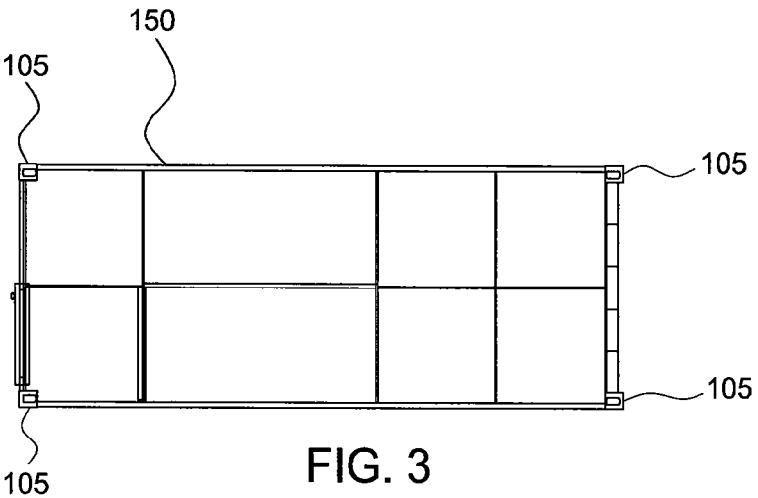
FIG. 3 is a view illustrating the second floor of the RATPAC in FIG. 1.
Figure 2:
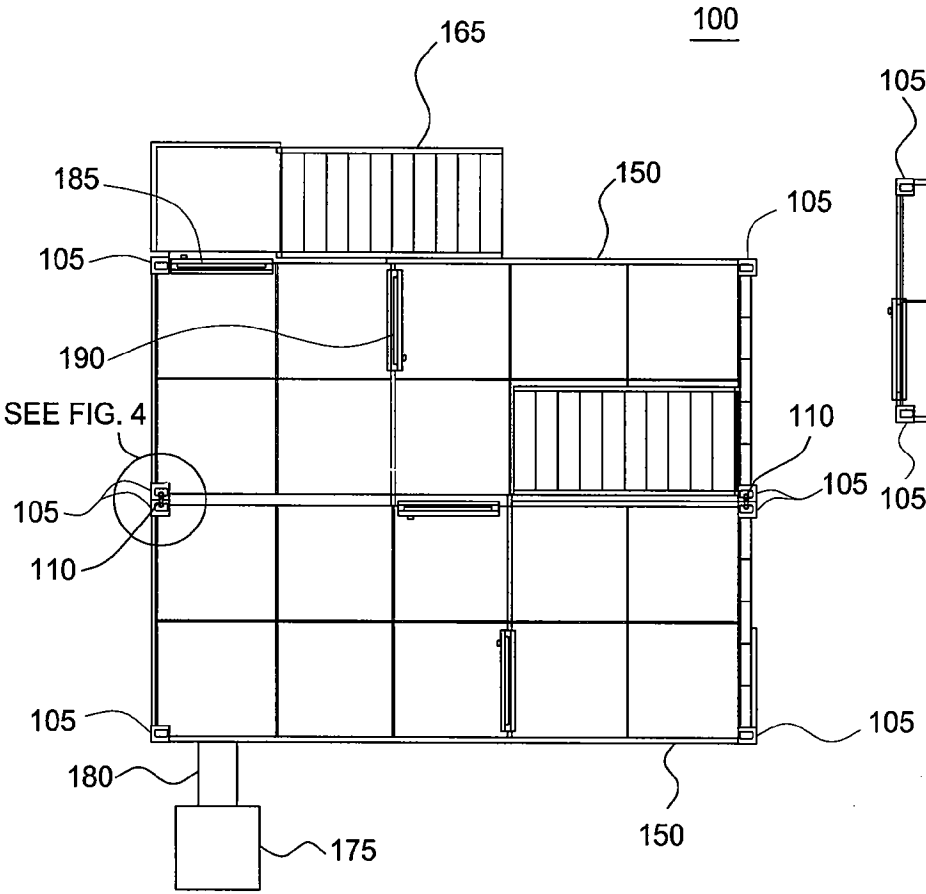
FIG. 2 is a view illustrating the first floor of the RATPAC in FIG. 1.

FIG. 2 is a view illustrating the first floor of the RATPAC 100 in FIG. 1 and FIG. 3 is a view illustrating the second floor of the RATPAC 100 in FIG. 1. As shown in FIG. 2, the RATPAC 100 includes two modular units 150 side by side and as shown in FIG. 3 a single modular unit 150 on the second floor. As clearly shown in FIGS. 2 and 3, each modular unit 150 has the same exterior dimensions. In other words, each modular unit 150 has the same structural footprint, thereby allowing the modular unit 150 to be arranged in numerous configurations. As previously described, each modular unit 150 includes a number of subsystems that are interconnected with other modular units to form a single unit. The single unit is connected to the control room 175 via the cord 180, thereby allowing the single unit to be controlled at one location.

Figure 4:
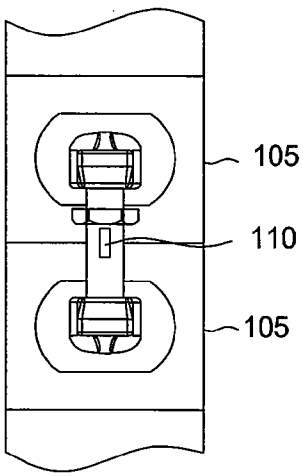
FIG. 4 is an enlarged view of corner connection members with a clamping member.

As shown in FIG. 2, the corner connection members 105 of the two modular units 150 are connected together by a clamping member 110, such as a bridge fitting. FIG. 4 is an enlarged view of the corner connection members 105. After the modular units 150 are positioned adjacent each other, a first end of the clamping member 110 is placed within the corner connection member 105 of one modular unit 150 and a second end of the clamping member 110 is placed within the corner connection member 105 of the other modular unit 150. Thereafter, the clamping member 110 is manipulated in order to connect the corner connection members 105, thereby interconnecting the two modular units 150. In this arrangement, the two modular units 150 are connected together without welding. It is to be noted that the clamping member 110 is releasable which allows the two modular units 150 to be separated, repositioned and subsequently reconnected in a different training configuration.

Figures 5, 6:
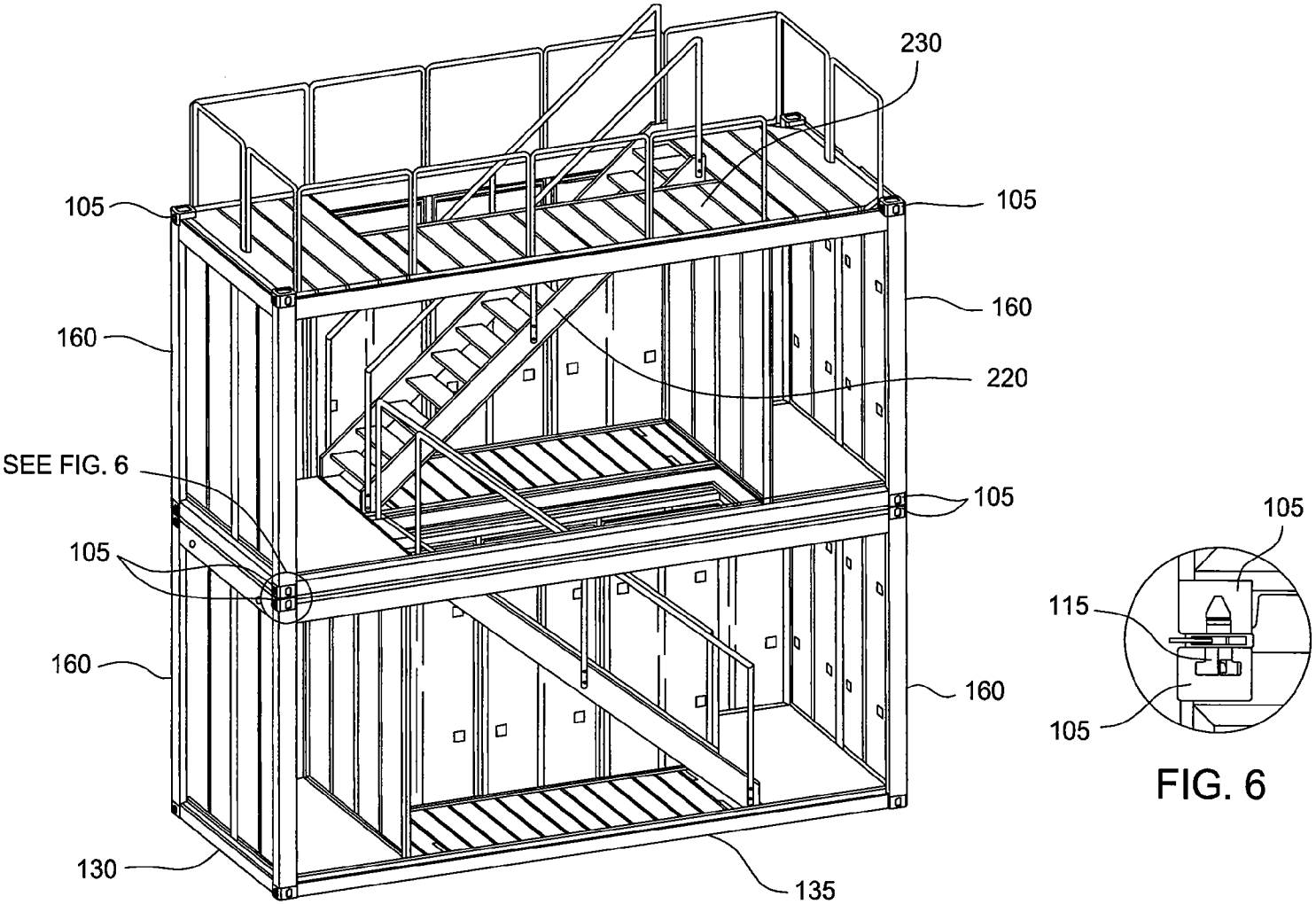
FIG. 5 is a view illustrating two modular units in a stacked configuration.
FIG. 6 is an enlarged view illustrating the corner connection members with a lock member.

FIG. 5 illustrates two modular units 150 in a stacked configuration. For convenience, the components in FIG. 5 that are similar to the components in FIGS. 1-4 will be labeled with the same number indicator. As shown in FIG. 5, one modular unit 150 is stacked on top of another modular unit 150 and the corner connection members 105 are connected together by a lock member 115, such as a twistlock stacker. As also shown in FIG. 5, the modular units 150 are designed to allow vertical access with the use of a stairway 220 or other vertical access members, such as ladders or hatches. A vertical opening may be centered on either side of the modular unit 150. Further, when the vertical opening is not in use, the opening may be sealed off with filler plates 230. This arrangement allows the modular unit 150 to be reconfigured from side to side, as well as end to end to change the direction of the stairway 220. Additionally, the stairway 220 is man-portable, and can be reconfigured without heavy equipment.

FIG. 6 is an enlarged view of the corner connection members 105 with the lock member 115. After the modular units 150 are positioned in a stacked configuration, a first portion of the lock member 115 is placed within the corner connection member 105 of one modular unit 150 and a second portion of the lock member 115 is placed within the corner connection member 105 of the other modular unit 150. Thereafter, the lock member 115 is manipulated in order to secure the corner connection members 105, thereby interconnecting the modular units 150. In this arrangement, the two modular units 150 are connected together and may also be disconnected by releasing the lock member 115 to allow the modular units 150 to be separated, repositioned and subsequently reconnected in a different training configuration.

Figure 7:
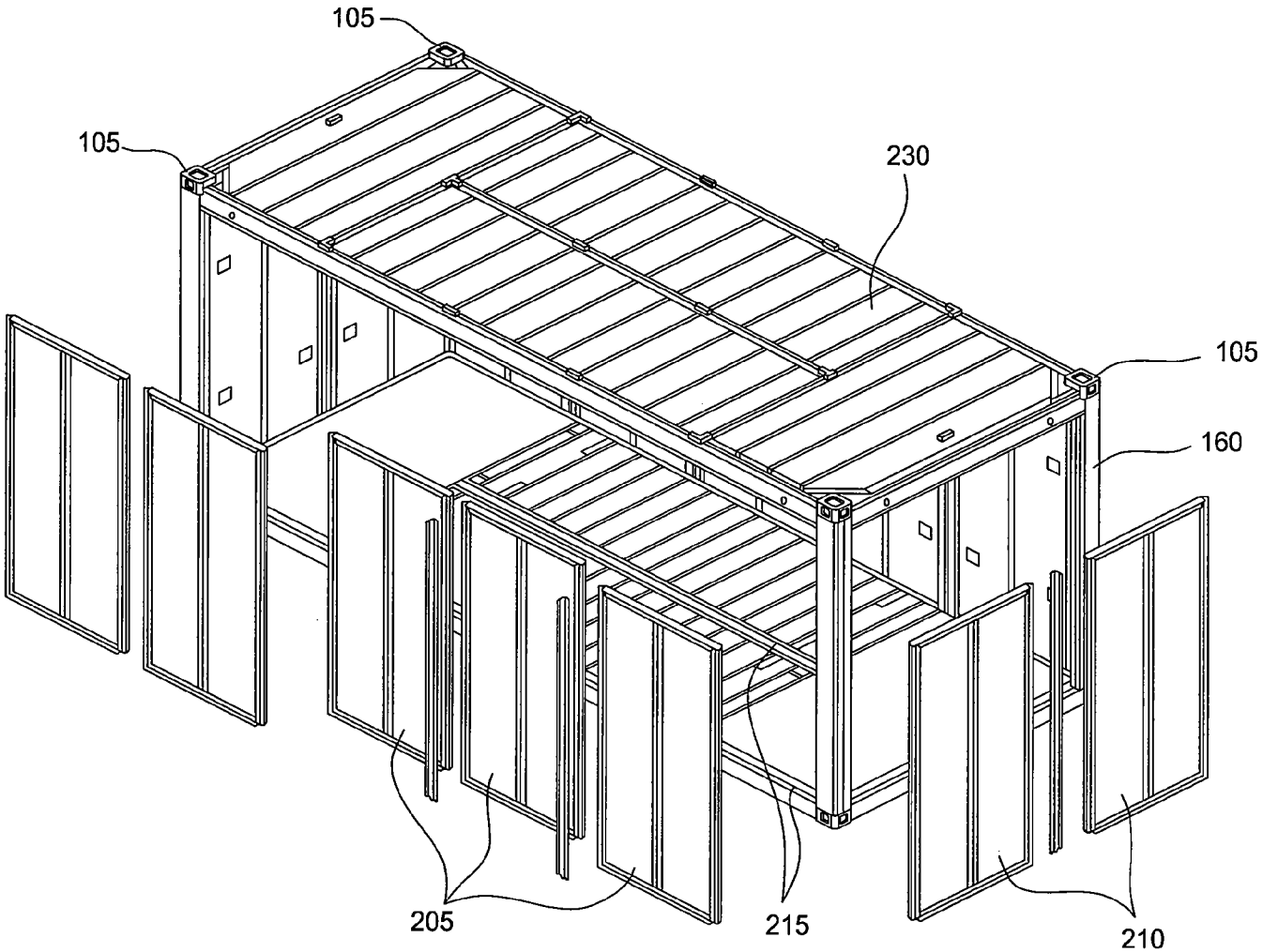
FIG. 7 is a view illustrating the modular unit with several panels removed.

FIG. 7 is a view of the modular unit 150 with several panels removed. For convenience, the components in FIG. 7 that are similar to the components in FIGS. 1-4 will be labeled with the same number indicator. Each modular unit 150 may include interior panels 205 and exterior panels 210 that are mounted on a grid system 215. The interior and/or exterior panels 205, 210 may include solid panels, window panels, and door panels, with or without breach capabilities. In one embodiment, the panels 205, 210 include bullet containment walls configured to allow live-fire within the modular unit 150. In another embodiment, the modular unit 150 may be configured for simulated munitions, such as paintballs. In this embodiment, the interior and/or exterior panels 205, 210 may be made from a lightweight material instead of a heavy material that is used with the bullet containment walls. In a further embodiment, the interior and/or exterior panels 205, 210 may be made from a composite, non-metallic construction. For instance, the interior and/or exterior panels 205, 210 may be made from a color-molded/textured fiber-reinforced plastic skin, over a plywood/honeycomb core. The interior and/or exterior panels 210, 215 may also be made from Kevlar® or other synthetic ballistic materials.

The interior and/or exterior panels 205, 210 may also include an edge detail that consists of an extruded edge section, which may be bonded to the panel in order to provide a weather tight fit of the panel components and a weather tight fit with the other panels and the grid system 215. Further, the interior and/or exterior panels 205, 210 may be corrosion resistant, lightweight, and strong and may allow for simple wipe-down cleaning if the training includes dye marking cartridges.

The interior and/or exterior panels 205, 210 may be configured as shoot-through wall panels which include an aluminum frame with a synthetic material cover. The synthetic material cover is releasably connected to the aluminum frame and may be replaced with another synthetic material cover. In one embodiment, the shoot through wall panels may be used with biodegradable marking projectiles. Additionally, it is to be noted that the interior and/or exterior panels 205, 210 are man-portable, and can be reconfigured without tools.

Figure 8:
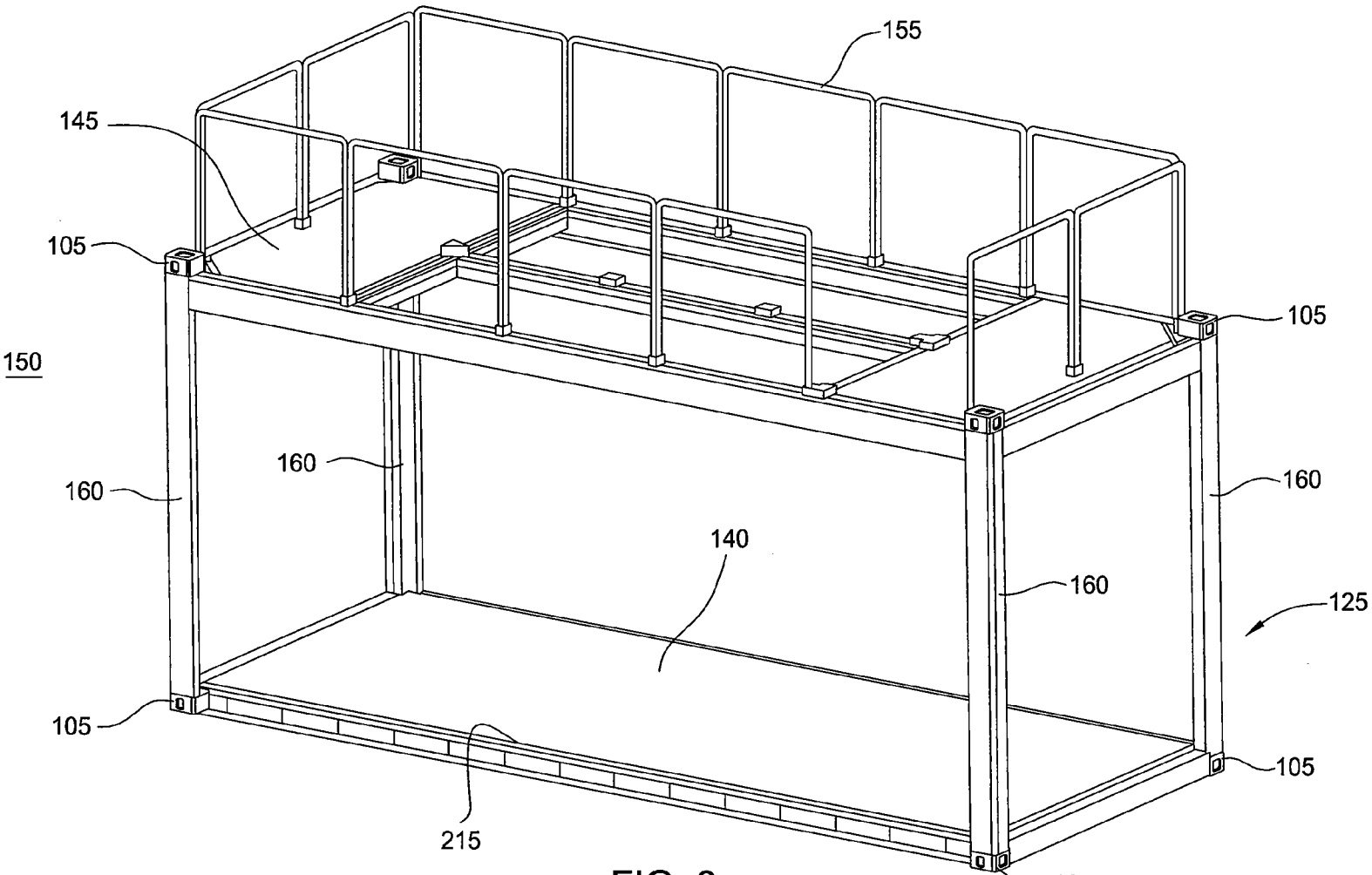
FIG. 8 is a view illustrating a frame structure of the modular unit.

FIG. 8 is a view illustrating a frame structure 125 of the modular unit 150. For convenience, the components in FIG. 8 that are similar to the components in FIGS. 1-4 will be labeled with the same number indicator. The frame structure 125 may be made from a metal, such as steel. As shown, the frame 125 structure includes the vertical support structures 160 interconnected with the horizontal support structures 130, 135. As also shown, the frame 125 includes the corner connection members 105 at each corner. Further, the frame structure 150 includes the grid system 215 to mount the panels which are interchangeable and can be mounted on interior partitions or exterior walls. Furthermore, the frame 125 may optionally include a lower floor 140, an upper floor 145 and rails 155.

The frame 125 may also include mounting ports for the rails 155 and integral rappel points. This allows roof-top access for sniper/training exercises, as well as rappelling down the modular units 150 through the windows.

The frame 125 does not require a permanent foundation. The contact points on the frame structure 125 are the corner connection members 105. The frame structure 125 is self supporting and can be assembled on any firm level surface. For installations on compacted gravel or soil, an optional bearing plate may be placed under the lower corner connection members 105. Additionally, it is to be noted that the lower floor 140 is spaced apart from the ground (or firm level surface).

Although the RATPAC 100 in the Figures illustrates a two or three module unit arrangement, the RATPAC 100 is scaleable from a single module arrangement to a multiple module arrangement with practically limitless floor plan possibilities. Additionally, the RATPAC 100 may be configured as a high rise building arrangement with multiple stories, thereby allowing the integration of rappelling and tactical training in a realistic setting using a single facility. Furthermore, the RATPAC 100 may include interior/exterior stairs and balconies, rappel points, and large open rooms to create a realistic tactical training facility.

In one embodiment, multiple RATPAC 100 buildings may be combined to create a live-fire Combined Arms Collective Training Facility (CACTF) capable of providing culminating urban operations training that was previously accomplished through an Urban Assault Course, a Shoot House, and Breach Facilities separately. A CACTF constructed using modular units 150 allows multiple units to train simultaneously on the collective tasks of breaching, tactical movement, target engagement and discrimination, building entry, and room clearance in a live-fire environment, wherein each modular unit 150 includes a bullet containment frame. Additionally, the multi-story RATPAC buildings can be constructed with rooftop over watch positions to allow the incorporation of elements such as command and control and security into the aforementioned live-fire training scenarios.

To develop an appropriate configuration to meet specific mission/training scenario requirements, 3 dimensional (3-D) computer simulations are conducted. Commercially available engineering architectural software, enhanced with proprietary programming, enables construction and viewing of the facility in a virtual world from a site perspective. Walk-throughs, fly-overs, and rotational views through 3-D animation enable the trainer to review the "completed" facility early in the design phase, to ensure targetry location, functionality, and training realism prior to finalizing the site detail design and tendering construction.

While the foregoing is directed to embodiments of the present invention, other and further embodiments of the invention may be devised without departing from the basic scope thereof, and the scope thereof is determined by the claims that follow.

The invention claimed is:

1. A reconfigurable training facility comprising:

a first modular unit; and a second modular unit, each modular unit includes a substantially rectangular frame with a corner connection member disposed at each corner of the frame, and a grid system configured to selectively support a plurality of panels, each corner connection member including a connection opening formed in one or more sides of the corner connection member, wherein a first releasable connection member is placed within the connection opening of the respective corner connection member to interconnect the modular units when a lower portion of the second modular unit is in contact with an upper portion of the first modular unit and, wherein a second releasable connection member is configured to interconnect the modular units when a side portion of the first modular unit is in contact with a side portion of the second modular unit, the second releasable connection having a body, a first end and a second end, wherein the body of the second releasable connection is disposed outside of the corner connection members and each end of the second releasable connection extends through the connection opening of the respective corner connection member.

2. The reconfigurable training facility of claim 1, wherein the panels are movable on the grid system between a first training scenario configuration and a second training scenario configuration.

3. The reconfigurable training facility of claim 2, wherein one of the plurality of panels is at a first location on the grid system in the first training scenario configuration and at a second location on the grid system in the second training scenario configuration.

4. The reconfigurable training facility of claim 1, wherein the first modular unit includes at least one portable target system for use in the first training scenario configuration and the second training scenario configuration.

5. The reconfigurable training facility of claim 1, wherein at least one modular unit includes a panel configured to contain a projectile within the modular unit.

6. The reconfigurable training facility of claim 1, further comprising a targetry arrangement which may be used in each training scenario configuration.

7. The reconfigurable training facility of claim 1, wherein the second modular unit is disposed next to the first modular unit in a side by side configuration.

8. The reconfigurable training facility of claim 1, wherein the second modular unit is disposed on top of the first modular unit in a stacked configuration.

9. The reconfigurable training facility of claim 1, further comprising an active ventilation system for circulating air through the modular unit.

10. The reconfigurable training facility of claim 1, further including a third modular unit disposable adjacent the first and the second modular unit.

11. A method of forming a training facility, the method comprising:

positioning a first modular unit at a predetermined location, the first modular unit having a corner connection member at each corner of a substantially rectangular frame;

positioning a second modular unit adjacent the first modular unit, the second modular unit having a corner connection member at each corner of a substantially rectangular frame;

connecting the first modular unit with the second modular unit to form a first training scenario configuration by using a releasable connection haying a body, a first end and a second end, wherein the body of the releasable connection is disposed outside of the corner connection members and each end of the releasable connection extends through a connection opening of the respective corner connection member;

disconnecting the modular units by removing the releasable connection; and repositioning the second modular unit relative to the first modular unit and connecting each modular unit to form a second training scenario configuration.

12. The method of claim 11, wherein the first modular unit includes at least one panel mounted on a grid system in the first training scenario configuration.

13. The method of claim 12, further comprising relocating the at least one panel to a different position on the grid system in the second training scenario configuration.

14. The method of claim 11, further comprising controlling a targetry arrangement in each modular unit via a computer subsystem.

15. The method of claim 11, wherein the second modular unit is disposed next to the first modular unit in a side by side configuration.

16. The method of claim 11, further including positioning a third modular unit on top of the first modular unit.

17. The reconfigurable training facility of claim 1, wherein the corner connection member at each upper corner extends above an upper surface of the frame and the corner connection member at each lower corner is disposed within the frame such that an outer surface of the corner connection member is substantially flush with a lower surface of the frame.

18. The reconfigurable training facility of claim 1, wherein the frame includes a vertical member at each corner of the frame and wherein an upper corner connection member is attached to an upper end of the vertical member and a corner connection member is attached to a lower end of the vertical member.

19. The reconfigurable training facility of claim 1, further comprising a reconfigurable stairway disposed within the first modular unit.

20. The reconfigurable training facility of claim 19, wherein the reconfigurable stairway extends between a floor of the first modular unit and a vertical opening in a roof of the first modular unit.

21. The reconfigurable training facility of claim 1, wherein the first modular unit includes a first vertical opening and a second vertical opening formed in a roof of the first modular unit.

22. The reconfigurable training facility of claim 21, wherein the first vertical opening and the second vertical opening are configured to receive a portion of a reconfigurable stairway or a filler plate.

23. The reconfigurable training facility of claim 21, wherein the first vertical opening is configured to receive a portion of a reconfigurable stairway and the second vertical opening is configured to receive a filler plate.

24. The reconfigurable training facility of claim 1, wherein each corner connection member is in a shape of a cube.

25. The reconfigurable training facility of claim 1, wherein the second modular includes a plurality of mounting ports attached to an upper portion of the frame that are configured to receive handrail portions.

* * * * *

UNITED STATES PATENT AND TRADEMARK OFFICE

CERTIFICATE OF CORRECTION

PATENT NO. : 8,186,109 B2
APPLICATION NO. : 12/405651
DATED : May 29, 2012
INVENTOR(S) : Warminsky It is certified that error appears in the above-identified patent and that said Letters Patent is hereby corrected as shown below:

In the Claims:

Column 8, Claim 11, Line 57, please delete "haying" and insert --having-- therefor.

Signed and Sealed this
Eleventh Day of September, 2012

David J. Kappos

David J. Kappos
*Director of the United States Patent and Trademark Office*